US008984712B2

(12) United States Patent
Peng

(10) Patent No.: US 8,984,712 B2
(45) Date of Patent: Mar. 24, 2015

(54) CYCLONE SEPARATION DEVICE AND CYCLONE VACUUM CLEANER MOUNTED WITH SAME

(75) Inventor: Zhongmei Peng, Jiangsu (CN)

(73) Assignee: Ecovacs Robotics (Suzhou) Co., Ltd., Suzhou, Jiangsu (CN)

( * ) Notice: Subject to any disclaimer, the term of this patent is extended or adjusted under 35 U.S.C. 154(b) by 77 days.

(21) Appl. No.: 13/976,855

(22) PCT Filed: Dec. 23, 2011

(86) PCT No.: PCT/CN2011/084560

§ 371 (c)(1), (2), (4) Date: Jun. 27, 2013

(87) PCT Pub. No.: WO2012/089073

PCT Pub. Date: Jul. 5, 2012

(65) Prior Publication Data

US 2013/0291334 A1 Nov. 7, 2013

(30) Foreign Application Priority Data

Dec. 29, 2010 (CN) ..... 2010 1 0624908

(51) Int. Cl.
*A47L 9/16* (2006.01)

(52) U.S. Cl.
CPC ..... *A47L 9/1625* (2013.01); *A47L 9/1641* (2013.01); *A47L 9/165* (2013.01)
USPC ..... 15/353; 15/347

(58) Field of Classification Search
USPC ..... 15/353, 327.6, 327.7, 347; 55/337, 345, 55/346, 34, DIG. 3
See application file for complete search history.

(56) References Cited

U.S. PATENT DOCUMENTS 7,169,201 B2 * 1/2007 Oh et al. ..... 55/343
7,261,754 B2 * 8/2007 Oh et al. ..... 55/343

(Continued)

FOREIGN PATENT DOCUMENTS

CN 1748632 A 3/2006
CN 1969739 A 5/2007

(Continued)

OTHER PUBLICATIONS

International Search Report: mailed Mar. 15, 2012; PCT/CN2011/084560.

*Primary Examiner* — Dung Van Nguyen
(74) *Attorney, Agent, or Firm* — Ladas & Parry LLP

(57) ABSTRACT

A cyclone separation device (102, 202) and a cyclone vacuum cleaner (100, 200) mounted with the device. A first cyclone separation unit in the cyclone separation device (102, 202) comprises a dust bucket (10) and a mesh filter (7) with air holes (7*a*). Airflow enters the first cyclone separation unit to undergo first gas-solid separation. The airflow after the separation enters a second cyclone separation unit through the air holes (7*a*) of the mesh filter (7). A filter in the second cyclone separation unit comprises a plurality of cyclone barrels (31). An upper end and a lower end of the cyclone barrel (31) are open. A first air inlet (31*a*) and a second air inlet (31*b*) are disposed on a side wall of the cyclone barrel (31). The airflow (41*a*, 41*b*) after the gas-solid separation enters the first air inlet (31*a*) and the second air inlet (31*b*) through a first airflow passage and a second airflow passage respectively, is mixed in the cyclone barrel (31), and then undergoes second gas-solid separation. The airflow after the gas-solid separation is discharged from an opening at the upper end of the cyclone barrel (31). In the cyclone separation device (102, 202), the direction of travel of the airflow and the cross-sectional area of the air inlet are changed, thereby improving a separation effect. The cyclone vacuum cleaner (100, 200) mounted with the cyclone separation device (102, 202) increases separation efficiency and improves an air purification effect.

20 Claims, 8 Drawing Sheets

(56) References Cited

U.S. PATENT DOCUMENTS

| | | | | |
|---|---|---|---|---|
| 7,473,289 | B2 * | 1/2009 | Oh et al. | 55/318 |
| 7,491,255 | B2 * | 2/2009 | Jung | 55/343 |
| 7,785,383 | B2 * | 8/2010 | Oh et al. | 55/343 |
| 8,152,878 | B2 * | 4/2012 | McLeod | 55/343 |
| 2009/0193772 | A1 | 8/2009 | Oh et al. | |

FOREIGN PATENT DOCUMENTS

| | | | |
|---|---|---|---|
| CN | 2922759 | Y | 7/2007 |
| CN | 201333004 | Y | 10/2009 |
| CN | 101653345 | A | 2/2010 |
| CN | 101862165 | A | 10/2010 |
| CN | 201958793 | U | 9/2011 |

* cited by examiner

CYCLONE SEPARATION DEVICE AND CYCLONE VACUUM CLEANER MOUNTED WITH SAME

FIELD OF THE INVENTION

The present invention belongs to the technical field of cleaning equipment, and relates to a cyclone separation device and a cyclone vacuum cleaner mounted with such device.

DESCRIPTION OF THE PRIOR ART

A vacuum cleaner is configured to clean dust with a negative pressure generated by its built-in motor-driven air blower. During its operation, the vacuum cleaner can suck out the dust in the slits or on the carpet which are uneasy to be removed in normal way while not making the dust floating upward, which has the advantages of convenient usage and easy operation, so such vacuum cleaner is widely used either at home or in public.

As the living conditions of the people are increasingly improved, their consciousness to environmental protection is also gradually heightened, that is, the users not only require that the vacuum cleaner can effectively collect dust, some other factors such as service life, noise and dust collection efficiency are also their concern. Therefore, the vacuum cleaner mounted with a cyclone separation device has emerged accordingly, which has been popularly approved by the user.

The cyclone vacuum cleaner is a kind of cleaning equipment configured to separate the dusts from the air by means of a centrifugal force generated by a swirling airflow. The typical cyclone vacuum cleaner available commercially includes two cyclone units connected in series, in which, the bigger dirt in the air are separated within the first cyclone unit, while the fine particles are separated within the second cyclone unit. A Chinese invention (publication number: CN101862165A) has disclosed a cyclone separation device unit, in which a cyclone body in its second cyclone unit adopts a dual-inlet air intake mode, so as to improve or suppress the vortex core deformation of airflow in the cyclone body and thus improve the separation efficiency of cyclone barrels. However, as shown in FIG. 1, said invention has the following disadvantages, that is, in the second cyclone unit, each of the cyclone barrels has at least two air inlets, and a part of airflow respectively enters each of the first air inlets 21*a* from the side through the airflow passage 3, while another part of airflow is respectively introduced into each of the second air inlets 21*b* through a sub-passage 502. To assure that the positions of the two air inlets on the cyclone barrels are separated by phase difference of 180 degree around the rotation axis of cyclone barrels, the airflow passage 3 and the sub-passage 502 occupy a considerably big space of the second cyclone separation unit, thus interfering the arrangement and dimension of cyclone barrels and restricting the maximized utilization of the space. Additionally, in such design of airflow passages, because the adjacent airflow passages have substantially the same wind speed, both ends of the dirty substances are subjected to substantially the same force. When the dirty substances are blocked by the cyclone barrels, they cannot escape. As the result, some dusts such as hairs or other strip-shaped dirt will accumulate on the outer walls of the cyclone barrels near the adjacent airflow passages, thus affecting the cleaning effect later.

SUMMARY OF THE INVENTION

In view of above disadvantage of the prior art, the technical problem of the present invention is directed to provide a cyclone separation device, which can change the direction of travel of airflow and increase the cross-sectional area of air inlets on the cyclone barrels, so as to evenly distribute the airflows which enter the cyclone barrels and thus improve the separation efficiency.

The present invention also provides a cyclone vacuum cleaner mounted with said cyclone separation device, which can improve the overall separation efficiency and air cleaning effect.

The technical problem of the present invention is solved by the following technical solution.

The invention provides a cyclone separation device, comprising a first cyclone separation unit and a second cyclone separation unit, in which, the first cyclone separation unit includes a dust bucket 10 having a tangential inlet 10*a* and a mesh filter 7 having air holes 7*a*, airflow enters the first cyclone separation unit from the tangential inlet 10*a* to undergo a first gas-solid separation, the airflow after the first gas-solid separation enters the second cyclone separation unit through the air hole 7*a;* the second cyclone separation unit includes a separator 3 and a connecting barrel 5, the separator 3 comprises a plurality of cyclone barrels 31, the upper end and lower end of the clone barrels 31 are opened, a first air inlet 31*a* and a second air inlet 31*b* are provided on the side wall of the clone barrels 31;

the airflow after the first gas-solid separation includes a first airflow (41*a*) and a second airflow 41*b*, the first airflow 41*a* enters each of the first air inlets 31*a* through a first airflow passage, the second airflow 41*b* enters each of the second air inlets 31*b* through the gaps among the outer walls of the plurality of cyclone barrels 31 in a second airflow passage, the first airflow 41*a* and the second airflow 41*b* undergo a second gas-solid separation within the cyclone barrels 31, the airflow after the second gas-solid separation flows to the opening of the upper end of the cyclone barrels 31.

The first air inlet 31*a* and the second air inlet 3 1 b are symmetrically distributed on the side walls of the cyclone barrels 31.

A connecting barrel sealing cover 4 is provided below the separator 3, a circular hole is provided on the connecting barrel sealing cover 4, wherein the number of circular holes on the connecting barrel sealing cover 4 is equal to the number of the cyclone barrels 31.

A diameter of the circular hole on the connecting barrel sealing cover 4 is greater than or equal to a diameter of the lower end of each cyclone barrel 31, but is smaller than a diameter of the upper end of the cyclone barrel 31, the cyclone barrels 31 are connected with a connecting barrel 5 through the circular holes of the connecting barrel sealing cover 4.

The connecting barrel sealing cover 4 is hermetically connected with the connecting barrel 5.

Both the first airflow passage and the second airflow passage comprise a gap between the inner wall of the mesh filter 7 and the outer wall of the connecting barrel 5.

The cyclone separation device comprises a tapered hole cover 1, which is located above the dust bucket 10, the first airflow passage also comprises a gap among the outer wall of the separator 3, the inner wall of the tapered hole cover 1 as well as the inner walls of the mesh filter 7.

The second airflow passage also comprises a recess 301 provided on the outer walls of the separator 3, the second airflow 41*b* enters the gaps between the outer walls of the plurality of cyclone barrels 31 through the recess 301.

The air holes 7*a* are a plurality of through holes provided on the mesh filter 7.

The first air inlet 31*a* and the second air inlet 31*b* have the same cross-sectional areas.

The number of the cyclone barrels 31 is 6 to 12, which are evenly distributed around the central axis of the separator 3.

Preferably, the number of the cyclone barrels 31 is 8.

The first air inlet 31*a* of the cyclone barrels 31 opens towards the outer side of the separator 3, and the second air inlet 31*b* of the cyclone barrels 31 opens towards the inner side of the separator 3.

Preferably, the cyclone separation device is further provided with a central cyclone barrel 32, which is provided at the central position of the separator 3, two air inlets 32*a* are provided on the side wall of the central cyclone barrel 32, the second airflow 41*b* enters the two air inlets 32*a* through the second airflow passage.

An angle between the axis of the cyclone barrels 31 and the axis of the cyclone separation device is 6°~12°.

Preferably, the angle between the axis of the cyclone barrels 31 and the axis of the cyclone separation device is 8°.

The invention also provides a cyclone vacuum cleaner, comprising a vacuum cleaner body and a suction head, the cyclone separation device described as above is provided in the vacuum cleaner body.

As compared with the prior art, the present invention has the following beneficial effects:

The cyclone separation device of the present invention features simple structure, the airflow entering the second cyclone separation unit is evenly distributed into each of the cyclone barrels. Under a predetermined cross-sectional area of cyclone barrels, the cross-sectional areas of two air inlets of the cyclone barrels can be expanded. The cyclone vacuum cleaner mounted with this cyclone separation device may further improve the overall efficiency of vacuum cleaner, so as to reduce accumulation of the dusts on the outside of cyclone barrels and to improve the air cleaning effect.

| Reference numbers of the attached drawings: | | | |
|---|---|---|---|
| 1. Tapered hole cover | 2. Separator sealing ring | 3. Separator | |
| 31. Cyclone barrels | 301. Recess | 31a. The first air inlet | |
| 31b. The second air inlet | 32. Central cyclone barrel | 32a. Air inlets | |
| 41a. The first Airflow | 41b. The second Airflow | 4. Connecting barrel sealing cover | |
| 5. Connecting barrel | 6. Bottom cover sealing ring of connecting barrel | | |
| 7. Mesh filter | 7a. Air hole | 8. Dust bucket sealing ring | 9. Dust-guard ring |
| 10. Dust bucket | 10a. Tangential air inlet | | |
| 11. Bottom cover sealing ring of dust bucket | | | |
| 12. Bottom cover of dust bucket | 13. Filter pad | 13a. Airflow sub-passage | |
| 14. Sealing ring of dust bucket cover | 15. Safety valve | | |
| 16. Dust bucket cover | 17. Handle cover | 18. Elastic member | |
| 19. Release button of dust bucket | | | |
| 100. Vertical cyclone vacuum cleaner | 200. Horizontal cyclone dust cleaner | | |
| 101, 201. Vacuum cleaner body | 102, 202. Cyclone separation device | | |
| 130, 230. Suction head | 25. Annular sub-passage | | |
| 502. Sub-passage | 21a. The first air inlet | 21b. The second air inlet | |

DETAILED DESCRIPTION OF THE PREFERRED EMBODIMENTS

Embodiment 1

Figure 1:
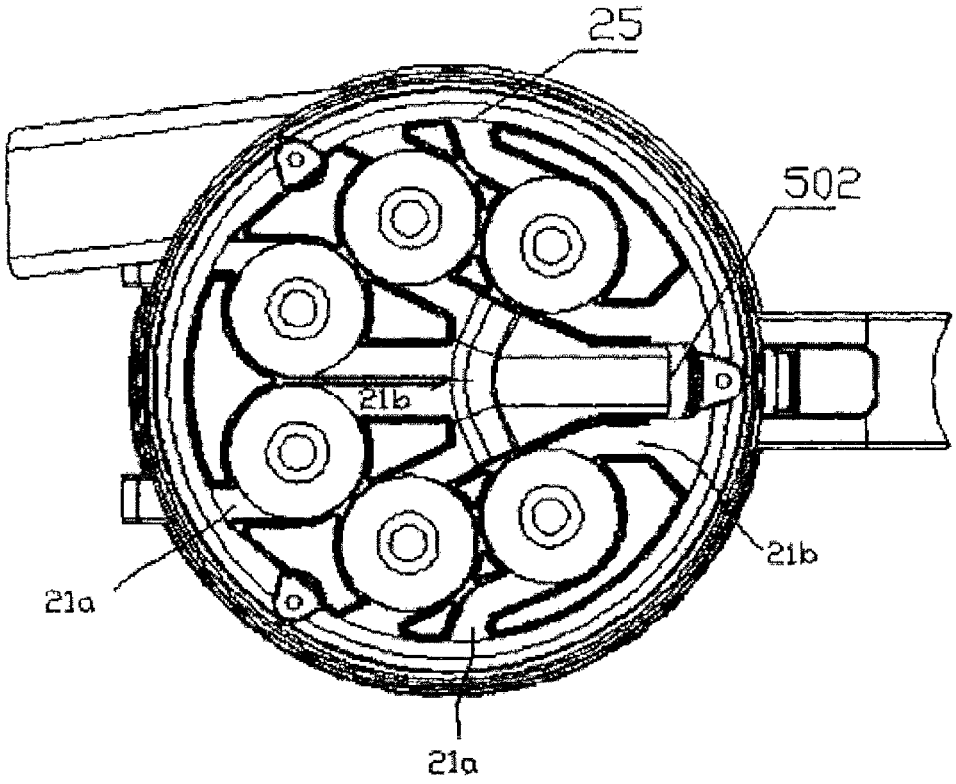
FIG. 1 is the top view of the cyclone separation device used for the cyclone vacuum cleaner in the prior art.
Figure 2:
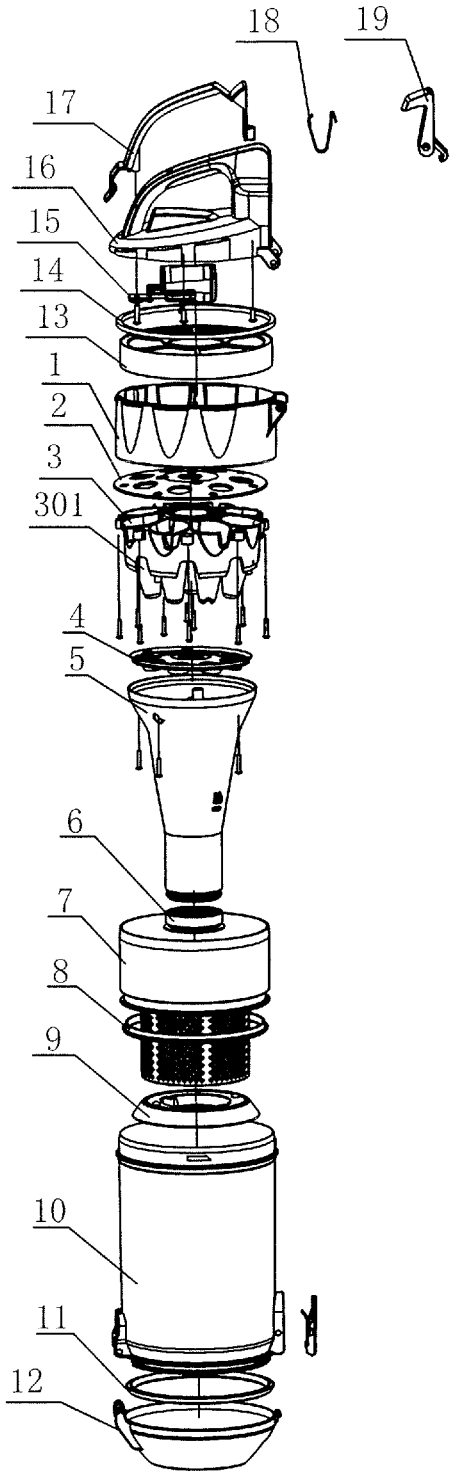
FIG. 2 is the 3D exploded view of the specific structure of the cyclone separation device according to the first embodiment of the present invention.
Figure 3:
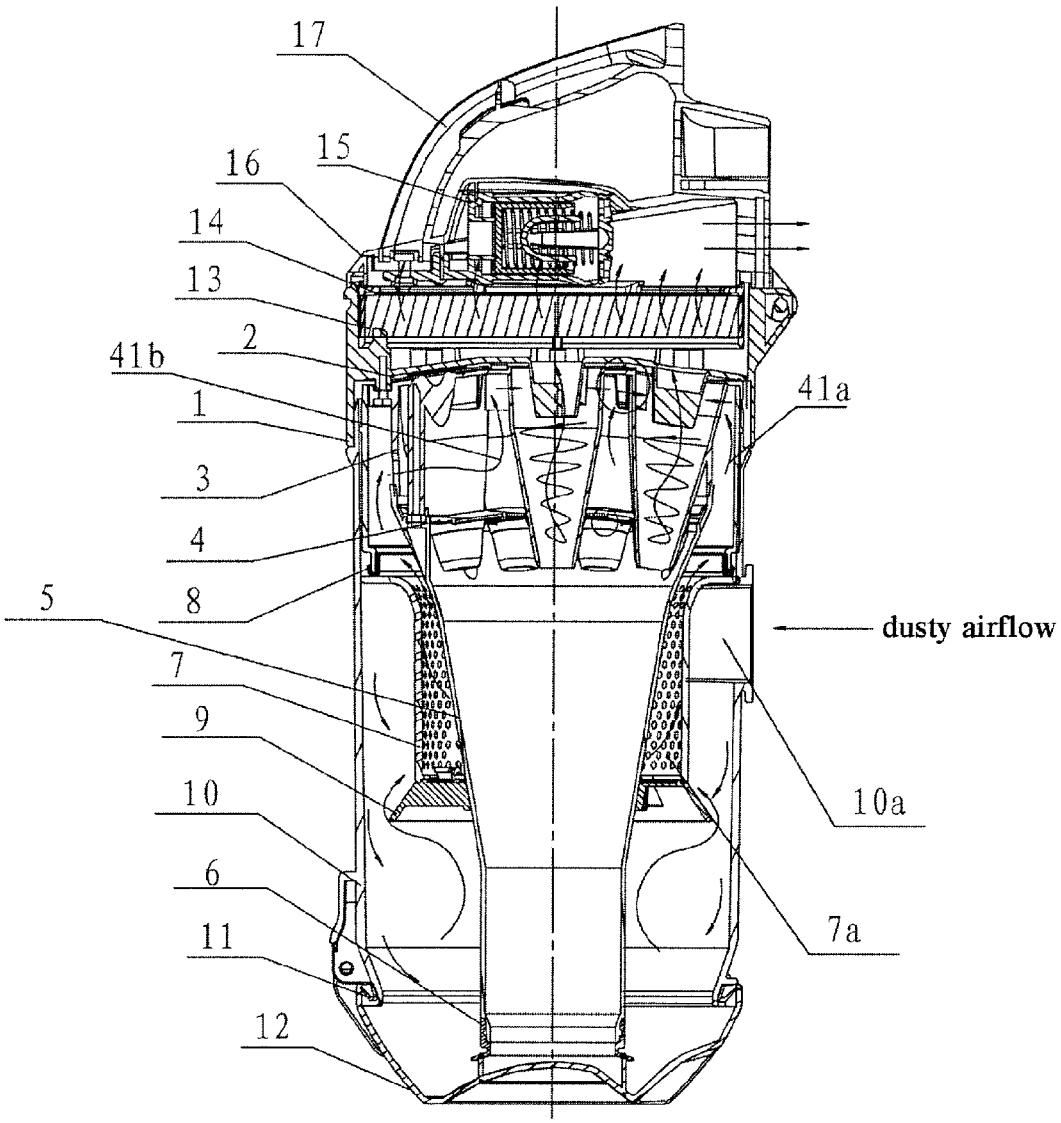
FIG. 3 is the schematic structure of the cyclone separation device according to the first embodiment of the present invention.

As shown in FIGS. 2 and 3, the cyclone separation device of the present invention comprises a first cyclone separation unit and a second cyclone separation unit. The first cyclone separation unit comprises a dust bucket 10 and a mesh filter 7. The dust bucket 10 is provided with a tangential air inlet 10*a* and is used to perform the gas-solid separation among the gas and the dirt such as particles, and its bottom is used to collect dirt; The mesh filter 7 is provide with a plurality of air holes 7*a*, which are through holes. The second cyclone separation unit is located at the downstream of the first cyclone separation unit, and comprises a separator 3 and a connecting barrel 5. The separator 3 is configured to filter small particles of dirt, and comprises a plurality of cyclone barrels 31, both the upper ends and lower ends of the cyclone barrels 31 are opened; Two tangential air inlets are provided on the side walls of the cyclone barrels 31. Specifically, these two air inlets may be distributed by a phase difference of 180 degree around the rotation axis of the cyclone barrels. To make the layout of the cyclone barrels 31 compact, there is provided an angle ranged generally from 6° to 12° between the axis line of the cyclone barrels 31 and the axis line of the cyclone separation device. In the present embodiment, such angle is 8°. To improve the effect of the second airflow separation, two air inlets are symmetrically distributed on the side walls of the cyclone barrels 31. A connecting barrel sealing cover 4 is provided under the separator 3 and also provided with circular holes. The number of the circular holes is same as that of the cyclone barrels 31. The diameter of each circular hole is greater than that of the opening at the lower end of the cyclone barrels 31 and is smaller than the diameter of opening at the upper end of the cyclone barrels 31. The cyclone barrels 31 pass through the circular holes of the connecting barrel sealing cover 4 and partially projected into the connecting barrel 5, then are connected with the connecting barrel 5 through the circular holes of the connecting barrel sealing cover 4. Alternatively, the diameter of the circular holes of the connecting barrel sealing cover 4 may also be equal to the diameter of the opening provided on the lower end of the cyclone barrels 31, and is smaller than the opening diameter at the upper end of cyclone barrels 31. The cyclone barrels 31 are provided on the connecting barrel 5 with their lower end openings corresponding to the circular hole of the connecting barrel sealing cover 4. Through the circular holes on the connecting barrel sealing cover 4, the cyclone barrels 31 are connected with the connecting barrel 5. The connecting barrel sealing cover 4 is hermetically connected with the connecting barrel 5.

Figure 4:
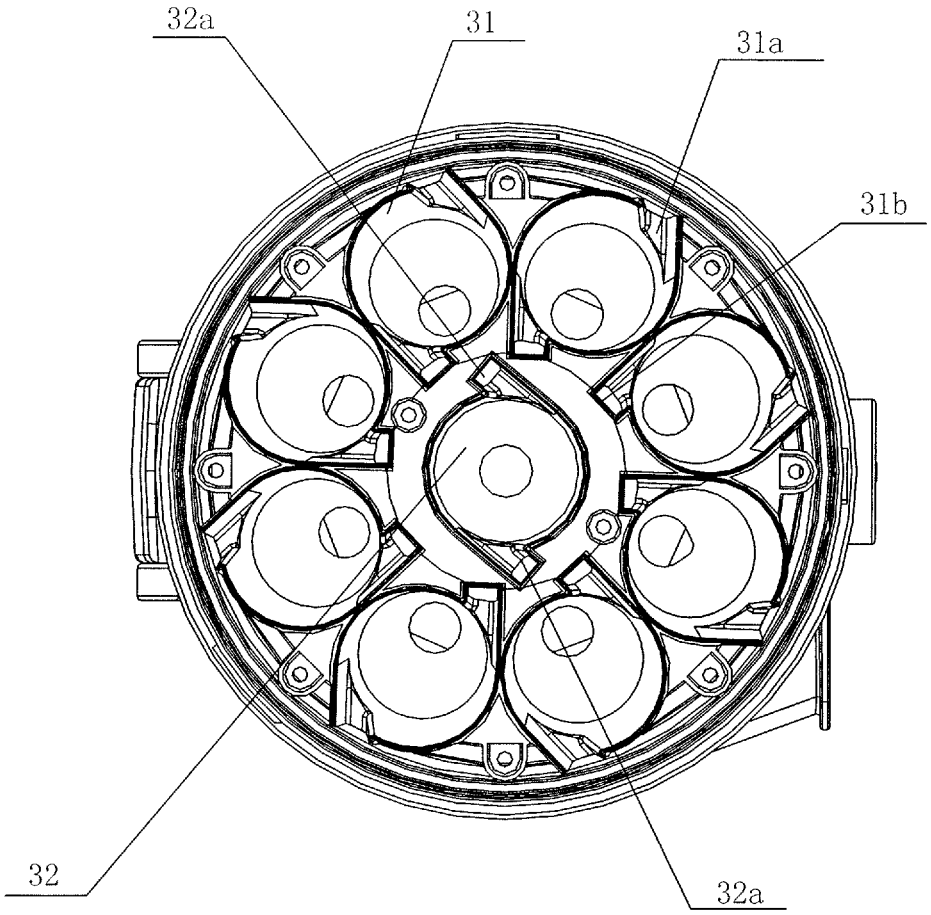
FIG. 4 is the top view of the separator in the cyclone separation device according to the first embodiment of the present invention.

FIG. 4 is the top view of the separator in the cyclone separation device. As shown in FIG. 4, the arrangement of the separator 3 is as follows: A plurality of cyclone barrels 31 are provided peripherally, the number of the cyclone barrels 31 may be 6~12; In the present embodiment, 8 cyclone barrels are evenly and closely arranged around the central axis of the separator 3. Two air inlets, namely the first air inlet 31*a* and the second air inlet 31*b*, are respectively provided on the side walls of the cyclone barrels 31. The first air inlet 31*a* opens towards the outer side of the separator 3; the second air inlet 31*b* opens towards the inner side of the separator 3. The first air inlet 31*a* and the second air inlet 31*b* are symmetrically distributed, and have the same height and cross-sectional area. Wherein, the first air inlets 31*a* of the plurality of cyclone barrels 31 locate on the same height, and the second air inlets 31*b* of the plurality of cyclone barrels 31 locate on the same height.

As shown in FIG. 4, to improve the cyclone separation effect in a more efficient way, a central cyclone barrel 32 is additionally provided in the separator 3. The central cyclone barrel 32 is provided at the central position of the separator 3; Two air inlets 32*a* are provided on the side walls of the central cyclone barrel 32 and have the same height. Correspondingly, a circular hole is provided at the central position of the connecting barrel sealing cover 4, so that the number of the circular holes on the connecting barrel sealing cover corresponds to the total number of the cyclone barrels 31 and the central cyclone barrel 32 provided in the separator 3.

The following description is further given of the operating process of the cyclone separation device in reference to the attached drawings.

Figure 5:
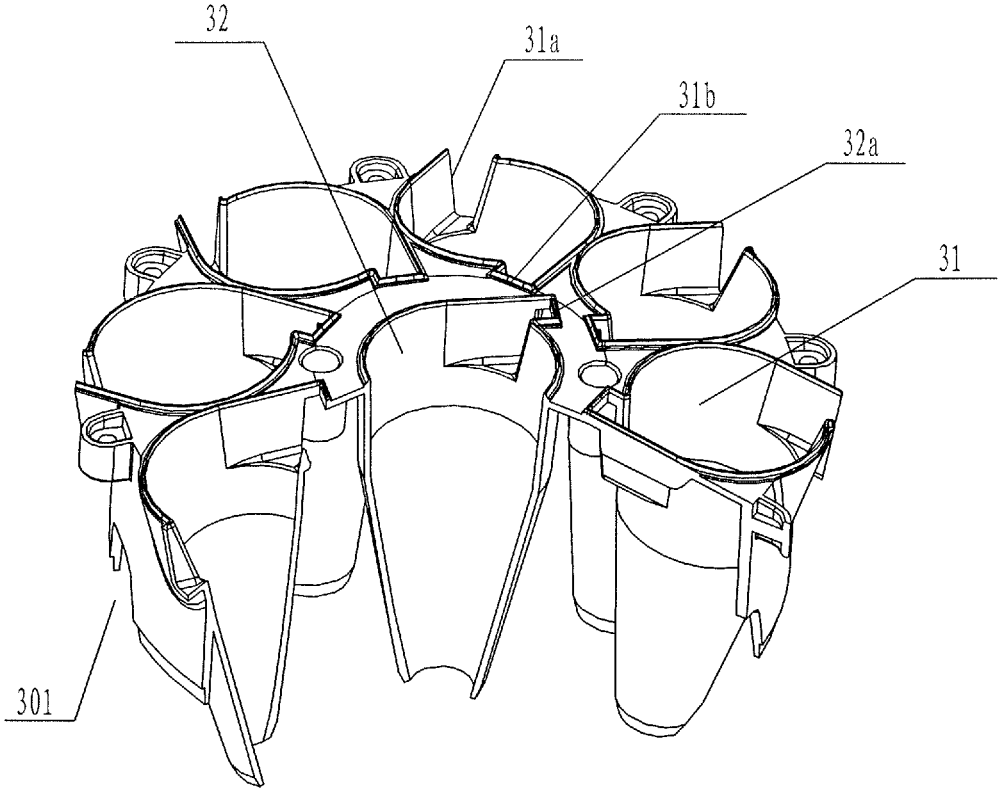
FIG. 5 is the partial schematic view of the separator of the cyclone separation device according to the first embodiment of the present invention.

As shown in FIGS. 3 and 5, an airflow carrying dirt such as dust and particles enters the dust bucket 10 through the tangential inlet 10*a* on the dust bucket 10; the airflow swirls in the dust bucket 10 to undergo the first gas-solid separation, so that big particles of dirt and some dusts are separated out from the airflow by means of the centrifugal force. Further, a dust-guard ring 9 provided on the mesh filter 7 can effectively prevent the dust from floating for the second time, and thus prevent the dust from blocking the air holes 7*a* provided on the mesh filter 7. After the gas-solid separation, the dirt falls into the bottom of the dust bucket 10. To guarantee the separation efficiency, the cyclone separation device has various sealing-rings provided at different positions thereof. For example, a bottom cover sealing ring 11 provided between the dust bucket 10 and the bottom cover 12 of dust bucket can effectively prevent the leakage of gas and dust; A dust bucket sealing ring 8 provided between the dust bucket 10 and the mesh filter 7 can effectively prevent the airflow in the dust bucket 10 from directly entering into the separator 3 without passing through the air holes 7*a* of the mesh filter 7. After the first gas-solid separation, the airflow enters into the second separation unit through the air holes 7*a* on the mesh filter 7, and then travels upwards along the outer walls of the connecting barrel 5.

The airflows after the first gas-solid separation include a first airflow 41*a* and a second airflow 41*b*; the first airflow 41*a* enters the first air inlet 31*a* through the first airflow passage; and the second airflow 41*b* enters the second air inlet 31*b* through the second airflow passage, the process is as follows:

The first airflow 41*a* travels upwards to the upper end of the connecting barrel 5 through the gaps between the inner wall of the mesh filter 7 and the outer walls of the connecting barrel 5, further travels upwards along the gaps located among the outer walls of the separator 3, the inner walls of the tapered hole cover 1 and the inner walls of the mesh filter 7, then directly enters into the cylinder barrels 31 from the first air inlet 31*a*; The first airflow passage comprises the gaps between the outer walls of connecting barrel 5 and the inner walls of the mesh filter 7 as well as the gaps among the outer walls of the separator 3, the inner walls of the tapered hole cover 1 and the inner walls of the mesh filter 7. The second gas current 41*b* travels upwards to the upper end of the connecting barrel 5 through the gaps between the inner walls of the mesh filter 7 and the outer walls of the connecting barrel 5, and enters into the gaps between the outer walls of cyclone barrels 31 via the recess 301 on the outer walls of the separator 3. At this time, the airflow travels upwards along the gaps between the outer walls of the cyclone barrels 31, and then enters into the second air inlet 31*b* of the cyclone barrels 31. The second airflow passage comprises the gaps between the outer walls of the connecting barrel 5 and the inner walls of the mesh filter 7 as well as the gaps between the recess 301 on the external surface of the separator 3 and the outer walls of the cyclone barrels 31. The first airflow 41*a* from the first air inlet 31*a* and the second airflow 41*b* from the second air inlet 31*b* join together within the cyclone barrels 31. The joined airflows are separated by means of a centrifugal force. The separated dirt falls into the connecting barrel through the lower openings of the cyclone barrels 31. The airflows after a second gas-solid separation are discharged from the upper opening of the cyclone barrels 31. The separator sealing ring 2 on the separator 3 seals the upper end of the separator 3 and the tapered hole cover 1, so as to effectively prevent air leakage. A filter pad 13 is located between the tapered hole cover 1 and the dust bucket cover 16 and used to filter the airflow after the second separation within the cyclone barrels 31, which can further filter the carried tiny dusts so as to make sure that the discharged airflow is clean. A sealing ring 14 of dust bucket cover is provided between the dust bucket cover 16 and the tapered hole cover 1 so as for sealing and effectively preventing air leakage. On the dust bucket cover, there are provided a safety valve 15, a release button 19 for operating the dust bucket and an elastic member 18. In case the cyclone device separator is blocked, the safety valve 15 may pop up to prevent the over-temperature of the motor, thus the motor is effectively protected; By operating the release button 19 of dust bucket, the dust bucket can be easily taken out from the cyclone separation device and properly place it back; the elastic member 18 is to make sure the release button 19 of dust bucket can be reset after being operated.

Second Embodiment

Figure 6:
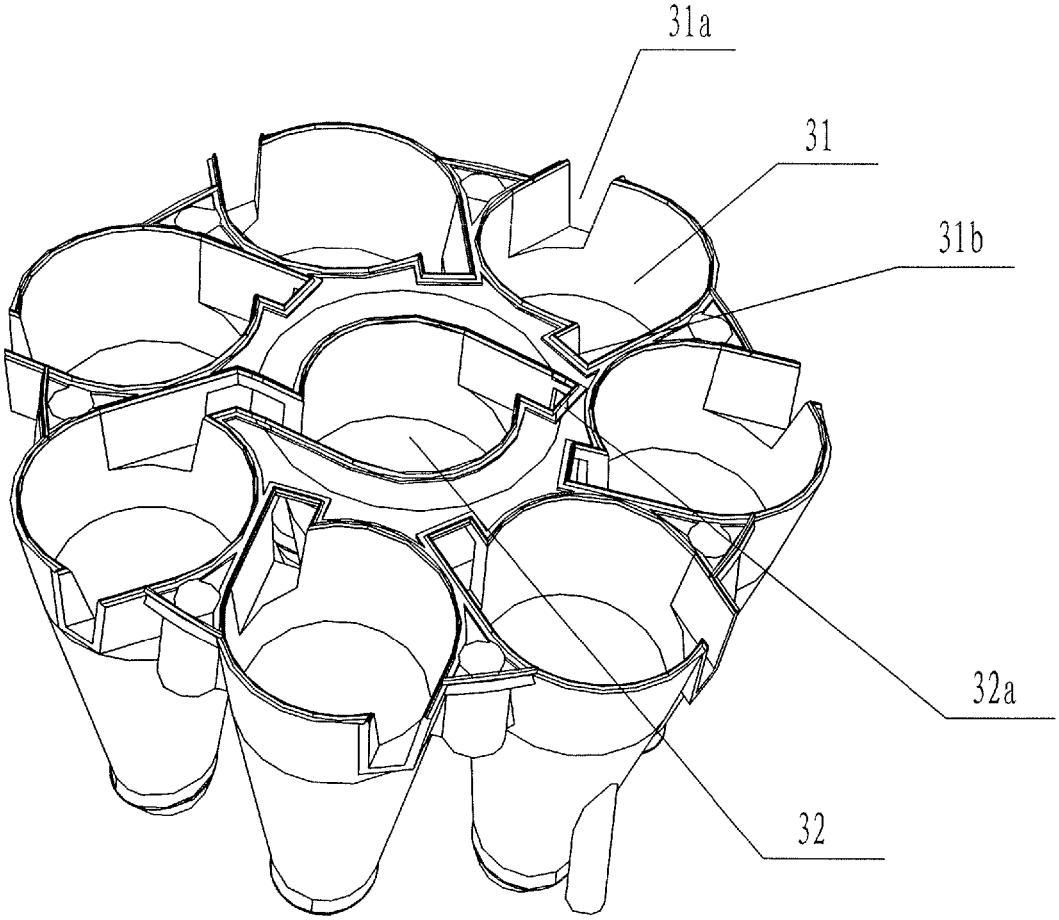
FIG. 6 is the schematic structure of the separator of the cyclone separation device according to the second embodiment of the present invention.

FIG. 6 schematically shows the structure of the separator in the cyclone separation device according to the second embodiment of the present invention. As shown in FIG. 6, the second embodiment differs from the first embodiment only in that: the separator 3 according to the second embodiment is configured by enclosing a plurality of cyclone barrels 31, and the external surfaces of the plurality of cyclone barrels 31 do not include an outer wall with recess. This separator 3 is placed on a connecting barrel with a gap therebetween, and the connecting barrel has been mounted with a collecting barrel sealing cover.

In this cyclone separation device, after a gas-solid separation by the first cyclone separation unit, the separated airflow enters into the second cyclone separation unit. The airflow after this first separation is branched into the first airflow and the second airflow. The first airflow travels in the same way as that of the first embodiment, that is, the first current passes through the gaps between the inner walls of mesh filter and the outer walls of the connecting barrel as well as the gaps among the outer walls of filter, the inner walls of tapered hole cover and the inner walls of the mesh filter. The second airflow not only passes through the gaps between the inner walls of mesh filter and the connecting barrel, but also passes through the gaps among the outer walls of cyclone barrels to directly enter the second air inlet.

Unlike the first embodiment, the second embodiment eliminates the recess provided on the separator, so that the airflow passage of the second airflow is simpler, while the same technical effect as the first embodiment can be achieved by reducing material and cost.

To sum up, in the present invention, a part of air passages are disposed at the gaps among the cyclone barrels 31, which makes the second cyclone separation unit has more utilizable space, thereby increasing the cross-sectional area of the air inlet of cyclone barrels 31 and further improving the air purification efficiency.

Figure 7:
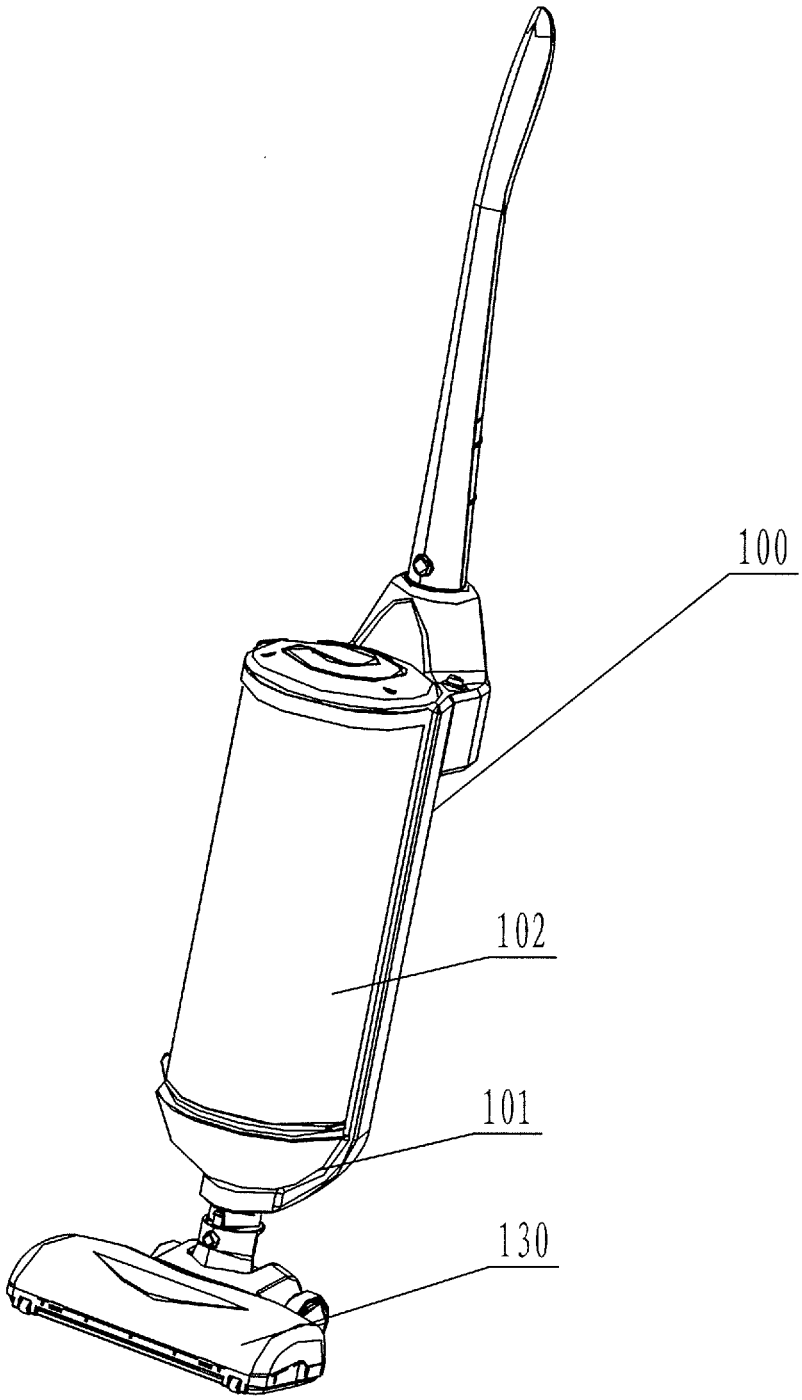
FIG. 7 is the perspective view of the vertical cyclone vacuum cleaner of the present invention.

FIG. 7 is a perspective view of the vertical cyclone vacuum cleaner of the present invention. As shown in FIG. 7, the vertical cyclone vacuum cleaner 100 comprises a vacuum cleaner body 101 and a suction head 130, the body 101 is provided with an electric air blower unit (not shown in the drawing), and the electric air blower unit is used as a swirling wind generator for generating suction force. The suction head 130 is communicated with the vacuum cleaner body 101 and is used to suck dusty air into it from the surface to be cleaned. The vertical cyclone vacuum cleaner 100 comprises a cyclone separation device 102 which is mounted on the vacuum cleaner body 101 and is communicated with the vacuum cleaner body 101 and the suction head 130; the cyclone separation device 102 is used to perform gas-solid separation, by which a clean airflow is discharged from the outlet of the electric air blower unit to the atmosphere. When the dust particles are fully collected, the user may take the cyclone separation device 102 out from the vacuum cleaner body 101, which implement the dust-dumping function.

Figure 8:
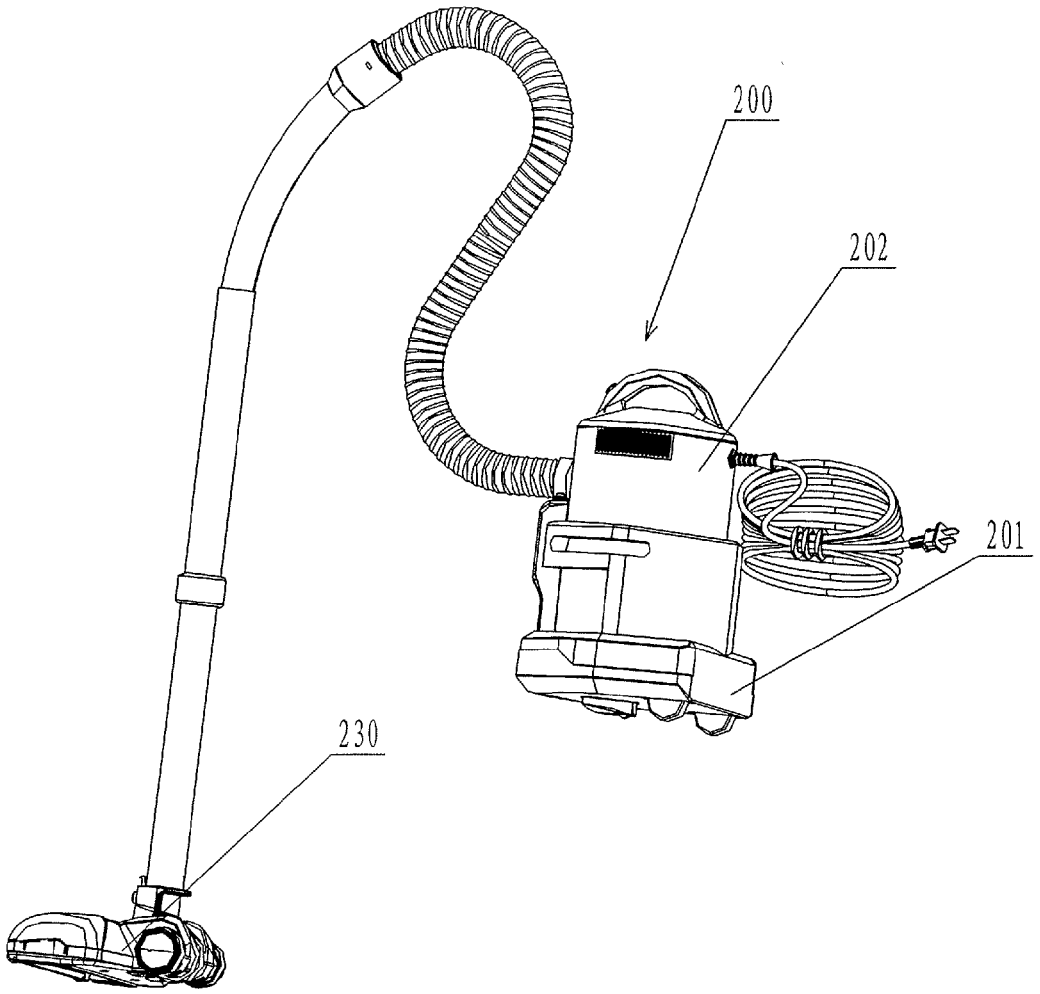
FIG. 8 is the perspective view of the horizontal cyclone vacuum cleaner of the present invention.

FIG. 8 is a perspective view of the horizontal cyclone vacuum cleaner of the present invention. As shown in FIG. 8, the horizontal cyclone vacuum cleaner 200 comprises a vacuum cleaner body 201 and a suction head 230, the body 201 is provided with an electric air blower unit (not shown in the drawing), and the electric air blower unit is used as a swirling wind generator for generating suction force. The suction head 230 is communicated with the vacuum cleaner body 201 and is used to suck dusty air into it from the surface to be cleaned. The horizontal cyclone vacuum cleaner 200 comprises a cyclone separation device 202 which is mounted on the vacuum cleaner body 201 and is communicated with the vacuum cleaner body 201 and the suction head 230; the cyclone separation device 202 is used to perform gas-solid separation, by which a clean airflow is discharged from the outlet of the electric air blower unit to the atmosphere. After the dust particles have been fully collected, the user may take the cyclone separation device 202 out from the vacuum cleaner body 201, which implements the dust-dumping function.

The present invention is not limited to the specific structural configuration described in the preferred embodiments of the specification. Obviously, there may be multiple modifications and structural combinations without going beyond the scope of the claims of the present invention.

The invention claimed is:

1. A cyclone separation device, comprising a first cyclone separation unit and a second cyclone separation unit, in which, the first cyclone separation unit includes a dust bucket having a tangential inlet and a mesh filter having air holes, airflow enters the first cyclone separation unit from the tangential inlet to undergo a first gas-solid separation, the airflow after the first gas-solid separation enters the second cyclone separation unit through the air hole;

the second cyclone separation unit includes a separator and a connecting barrel, the separator comprises a plurality of cyclone barrels, the upper end and lower end of the clone barrels are opened, a first air inlet and a second air inlet are provided on the side wall of the clone barrels wherein, the airflow after the first gas-solid separation includes a first airflow and a second airflow, the first airflow enters each of the first air inlets through a first airflow passage, the second airflow enters each of the second air inlets through the gaps among the outer walls of the plurality of cyclone barrels in a second airflow passage, the first airflow and the second airflow undergo a second gas-solid separation within the cyclone barrels, the airflow after the second gas-solid separation flows to the opening of the upper end of the cyclone barrels.

2. The cyclone separation device of claim 1, characterized in that, the first air inlet and the second air inlet are symmetrically distributed on the side walls of the cyclone barrels.

3. The cyclone separation device of claim 1, wherein a connecting barrel sealing cover is provided below the separator, a circular hole is provided on the connecting barrel sealing cover, wherein the number of circular holes on the connecting barrel sealing cover is equal to the number of the cyclone barrels.

4. The cyclone separation device of claim 3 wherein the connecting barrel sealing cover is hermetically connected with the connecting barrel.

5. The cyclone separation device of claim 1, wherein a diameter of the circular hole on the connecting barrel sealing cover is greater than or equal to a diameter of the lower end of each cyclone barrel, but is smaller than a diameter of the upper end of the cyclone barrel, the cyclone barrels are connected with a connecting barrel through the circular holes of the connecting barrel sealing cover.

6. The cyclone separation device of claim 1, wherein both the first airflow passage and the second airflow passage comprise a gap between the inner wall of the mesh filter and the outer wall of the connecting harrel.

7. The cyclone separation device of claim 6, wherein the cyclone separation device comprises a tapered hole cover, which is located above the dust bucket, the first airflow passage also comprises a gap among the outer wall of the separator, the inner wall of the tapered hole cover as well as the inner walls of the mesh filter.

8. The cyclone separation device of claim 1, wherein the second airflow passage also comprises a recess provided on the outer walls of the separator, the second airflow enters the gaps between the outer walls of the plurality of cyclone barrels through the recess.

9. The cyclone separation device of claim 1, wherein the air holes are a plurality of through holes provided on the mesh filter.

10. The cyclone separation device of claim 1, wherein the first air inlet and the second air inlet have the same cross-sectional areas.

11. The cyclone separation device of claim 1, wherein the number of the cyclone barrels is 6 to 12, which are evenly distributed around the central axis of the separator.

12. The cyclone separation device of claim 11, wherein the number of the cyclone barrels is 8.

13. The cyclone separation device of claim 11, characterized in that, the first air inlet of the cyclone barrels opens towards the outer side of the separator, and the second air inlet of the cyclone barrels opens towards the inner side of the separator.

14. The cyclone separation device of claim 11, wherein the cyclone separation device is further provided with a central cyclone barrel, which is provided at the central position of the separator, two air inlets are provided on the side wall of the central cyclone barrel, the second airflow enters the two air inlets through the second airflow passage.

15. The cyclone separation device of claim 1, wherein an angle between the axis of the cyclone barrels and the axis of the cyclone separation device is 6°~12°.

16. The cyclone separation device of claim 15, wherein the angle between the axis of the cyclone barrels and the axis of the cyclone separation device is 8°.

17. A cyclone vacuum cleaner, comprising a vacuum cleaner body and a suction head, the vacuum cleaner body is provided with a cyclone separation device, the cyclone separation device comprises a first cyclone separation unit and a second cyclone separation unit, in which the first cyclone separation unit includes a dust bucket having a tangential inlet and a mesh filter having air holes, airflow enters th first cyclone separation unit from the tangential inlet to undergo a first gas-solid separation, the airflow through the air hole;

the second cyclone separation unit includes a separator and a connecting barrel, the separator comprises a plurality of cyclone barrels, the upper end and lower end of the clone barrels are opened, a first air inlet and a second air inlet are provided on the side wall of the clone barrels, wherein, the airflow after the first gas-solid separation includes a first airflow and a second airflow, the first airflow enters each of the first air inlets through a first airflow passage, the second airflow enters each of the second air inlets through the gaps among the outer walls of the plurality of the cyclone barrels in a second airflow passage, the first airflow and the second airflow undergo a second gas-solid separation within the cyclone barrels, the airflow after the second gas-solid separation flows to the opening of the upper end of the cyclone barrels.

18. The cyclone vacuum cleaner of claim 17, both the first airflow passage and the second airflow passage comprise a gap between the inner wall of the mesh filter and the outer wall of the connecting barrel.

19. The cyclone vacuum cleaner of claim 18, the cyclone separation device comprises a tapered hole cover, which is located above the dust bucket , the first airflow passage also comprises a gap among the outer wall of the separator, the inner wall of the tapered hole cover as well as the inner walls of the mesh filter.

20. The cyclone vacuum cleaner of claim 17, the second airflow passage also comprises a recess provided on the outer wails of the separator, the second airflow enters the gaps between the outer walls of the plurality of cyclone barrels through the recess.

* * * * *